US008629748B2

(12) United States Patent
Nakada et al.

(10) Patent No.: US 8,629,748 B2
(45) Date of Patent: Jan. 14, 2014

(54) WIRE-WOUND INDUCTOR

(75) Inventors: Yoshinari Nakada, Takasaki (JP); Koichiro Wada, Takasaki (JP); Yuichi Kasuya, Takasaki (JP); Masanori Takahashi, Takasaki (JP); Masashi Kuwahara, Takasaki (JP); Tetsuo Kumahora, Takasaki (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 13/566,847

(22) Filed: Aug. 3, 2012

(65) Prior Publication Data

US 2013/0194060 A1 Aug. 1, 2013

(30) Foreign Application Priority Data

Aug. 25, 2011 (JP) ..... 2011-183446

(51) Int. Cl.

| | |
|---|---|
| ***H01F 17/04*** | (2006.01) |
| ***H01F 27/29*** | (2006.01) |
| ***H01F 1/03*** | (2006.01) |
| ***H01F 7/06*** | (2006.01) |
| ***C22C 37/06*** | (2006.01) |

(52) U.S. Cl.

USPC ..... 336/221; 336/192; 336/233; 148/100; 420/15; 29/602.1

(58) Field of Classification Search

USPC ..... 336/192, 221, 233; 29/602.1, 603.27; 148/100, 104, 105; 420/8, 15, 428, 420/458, 459

See application file for complete search history.

(56) References Cited

U.S. PATENT DOCUMENTS

| | | | | |
|---|---|---|---|---|
| 1,809,042 | A * | 6/1931 | Kelsall | 148/312 |
| 3,567,525 | A * | 3/1971 | Graham et al. | 148/302 |
| 5,522,946 | A | 6/1996 | Tomita et al. | |
| 7,270,718 | B2 * | 9/2007 | Nishijima et al. | 148/105 |
| 7,510,766 | B2 * | 3/2009 | Lemieux | 428/403 |

(Continued)

FOREIGN PATENT DOCUMENTS

| | | |
|---|---|---|
| JP | H04-361506 A | 12/1992 |
| JP | 2000-030925 A | 1/2000 |

(Continued)

OTHER PUBLICATIONS

Notification of Reasons for Refusal issued by Japanese Patent Office, mailed Jun. 22, 2012, for Japanese counterpart application No. No. 2011-183446.

(Continued)

*Primary Examiner* — Alexander Talpalatski
*Assistant Examiner* — Joselito Baisa
(74) *Attorney, Agent, or Firm* — Law Office of Katsuhiro Arai

(57) ABSTRACT

Provided are a small wire-wound inductor having desired inductor characteristics, while allowing for high-density mounting and low-height mounting on circuit boards at the same time, as well as a method for manufacturing such wire-wound inductor which has a drum-shaped core member constituted by an assembly of soft magnetic alloy grains containing iron (Fe), silicon (Si) and 2 to 15 percent by weight of chromium (Cr), a coil conductive wire wound around the core member, a pair of terminal electrodes connected to the terminals of the coil conductive wire, and an outer sheath member covering the wound coil conductive wire and constituted by a magnetic powder-containing resin having a specified magnetic permeation ratio.

14 Claims, 5 Drawing Sheets

Section A-A

(56) References Cited

U.S. PATENT DOCUMENTS

| | | | | |
|---|---|---|---|---|
| 8,323,374 | B2 * | 12/2012 | Kaneko et al. | 75/348 |
| 2002/0097124 | A1 | 7/2002 | Inoue et al. | |
| 2007/0290161 | A1 | 12/2007 | Tokuoka et al. | |
| 2008/0061264 | A1 | 3/2008 | Maeda et al. | |
| 2008/0152897 | A1 | 6/2008 | Maeda et al. | |
| 2008/0231409 | A1 | 9/2008 | Kugai et al. | |
| 2010/0289609 | A1 | 11/2010 | Liao et al. | |
| 2011/0024670 | A1 | 2/2011 | Otsuki et al. | |
| 2011/0267167 | A1 * | 11/2011 | Ogawa et al. | 336/221 |
| 2012/0146759 | A1 | 6/2012 | Shibuya et al. | |

FOREIGN PATENT DOCUMENTS

| | | | |
|---|---|---|---|
| JP | 2001-185421 | A | 7/2001 |
| JP | 2002-305108 | A | 10/2002 |
| JP | 2007-299871 | A | 11/2007 |
| JP | 2009-021310 | A | 1/2009 |
| JP | 2009-088496 | A | 4/2009 |
| JP | 2009-088502 | A | 4/2009 |
| JP | 2009-158735 | A | 7/2009 |
| JP | 2011-009644 | A | 1/2011 |
| WO | 2011/027559 | A1 | 3/2011 |

OTHER PUBLICATIONS

Korean Office Action issued by the Korean Patent Office, mailed Jul. 3, 2013, for Korean counterpart application No. 10-2012-0030970.

* cited by examiner (a)

(b)

WIRE-WOUND INDUCTOR

BACKGROUND

1. Field of the Invention

The present invention relates to a wire-wound inductor, and more specifically to a wire-wound inductor having a magnetic core and small enough to be surface-mounted onto a circuit board.

2. Description of the Related Art

Wire-wound inductors have been known as coils for power supply step-up/step-down circuits used in mobile electronic devices, choke coils used in high-frequency circuits, etc. Among the known wire-wound inductors is the one described in Patent Literature 1, for example, which is structured in such a way that a coil conductive wire is wound around a ferrite core and both ends of the coil conductive wire are soldered to a pair of terminal electrodes provided on the surface of the ferrite core. Here, the ferrite core has a so-called drum shape characterized by a core and a pair of flange parts provided at the upper end and lower end of the core. Wire-wound inductors having this constitution generally allow for reduction of outer dimensions (especially height dimension), which makes them suitable for high-density mounting and low-height mounting on circuit boards.

On the other hand, another known structure of wire-wound inductors is the metal composite structure, for example, where a coil is powder-compacted using iron or iron-containing alloy and resin in a manner burying the coil in the metal. In general, inductors of the metal composite structure exhibit excellent inductor characteristics (especially energy characteristics) and are therefore suitable for power inductors in power-supply circuits and the like, for example.

PATENT LITERATURE

[Patent Literature 1] Japanese Patent Laid-open No. 2011-009644

SUMMARY

Electronic devices are becoming increasingly smaller, thinner and higher in function, and this trend is giving rise to a need for wire-wound inductors offering improved inductor characteristics while supporting higher mounting densities and lower mounting heights at the same time.

The object of the present invention is to provide a small wire-wound inductor having desired inductor characteristics, while allowing for high-density mounting and low-height mounting on circuit boards at the same time.

A wire-wound inductor conforming to the invention according to Embodiment 1 is characterized by comprising: a core member having a pillar-shaped core and a pair of flange parts provided on both sides of the core; a coil conductive wire wound around the core of the core member; a pair of terminal electrodes provided on the outer surfaces of the flange parts and connected to both ends of the coil conductive wire; and an insulation member covering the outer periphery of the coil conductive wire; wherein the core member is constituted by soft magnetic alloy grains containing iron, silicon and chromium, where each soft magnetic alloy grain has an oxidized layer of the soft magnetic alloy grain on its surface, the oxidized layer contains more chromium than does the soft magnetic alloy grain, and grains are bonded together via their oxidized layers; the soft magnetic alloy contains chromium by 2 to 15 percent by weight; the core member has a saturated magnetic flux density of 1.2 T or more, volume resistivity of $10^3$ to $10^9$ Ω·cm, and magnetic permeation ratio of 10 or more; and the insulation member is constituted by a resin material containing magnetic powder and has a specified magnetic permeation ratio.

The invention according to Embodiment 2 is a wire-wound inductor according to Embodiment 1, characterized in that the core member has outer dimensions of 3 to 5 mm in length and width, and a height dimension of 1.5 mm or less in a plan view of the outer surfaces of the flange parts.

The invention according to Embodiment 3 is a wire-wound inductor according to Embodiment 1 or 2, characterized in that the magnetic powder constituting the insulation member has the same composition and structure as the soft magnetic alloy grains constituting the core member.

The invention according to Embodiment 4 is a wire-wound inductor according to Embodiment 1 or 2, characterized in that the magnetic powder constituting the insulation member is made of Ni—Zn ferrite or Mn—Zn ferrite.

The invention according to Embodiment 5 is a wire-wound inductor according to any one of Embodiments 1 to 4, characterized in that the insulation member has a magnetic permeation ratio of 1 to 25.

According to the present invention, a small wire-wound inductor having desired inductor characteristics, while allowing for high-density mounting and low-height mounting on circuit boards at the same time, can be provided to contribute to size reduction, thickness reduction and functional enhancement of electronic devices equipped with such wire-wound inductor.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

Figure 1:
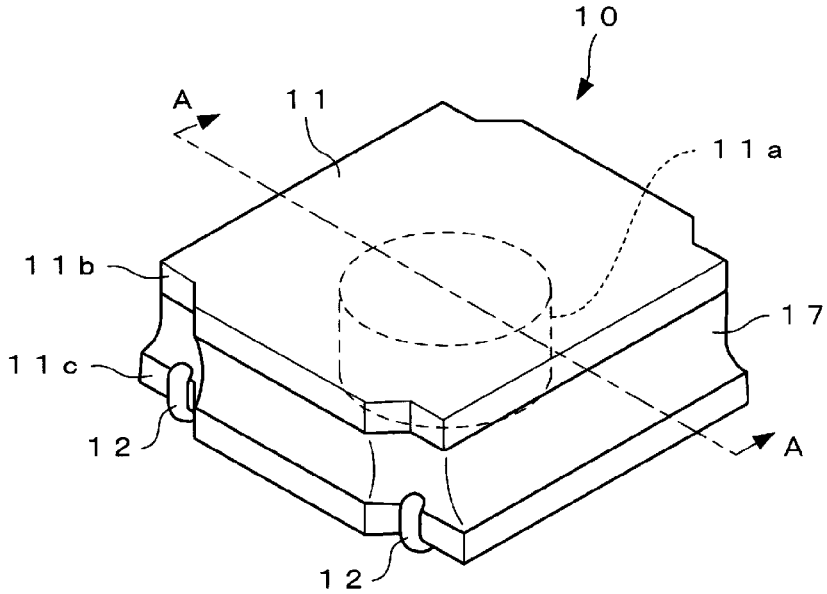
FIG. 1 illustrates schematic perspective views showing a top in (a) and a bottom in (b) of an embodiment of a wire-wound inductor conforming to the present invention.
Figure 1:
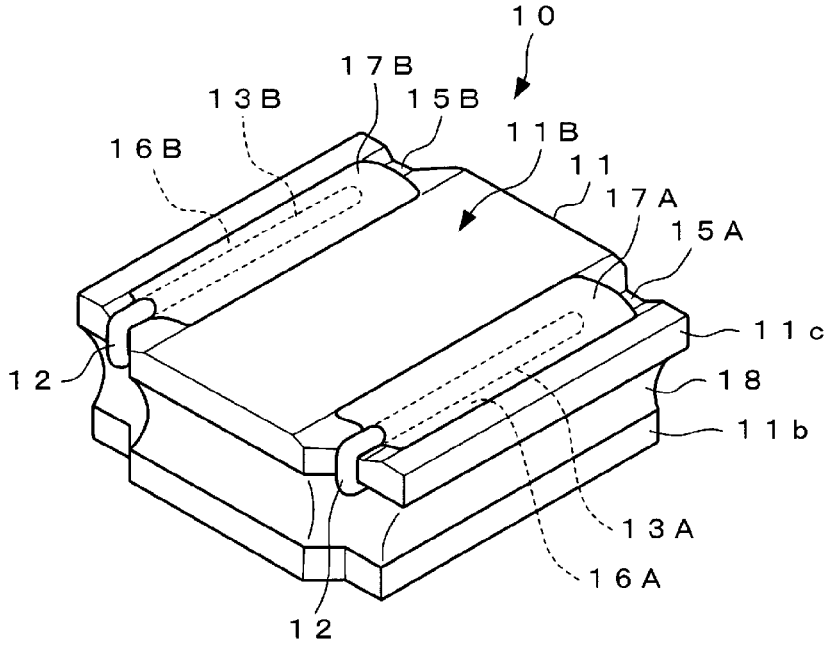

10 Wire-wound inductor
11 Core member
11*a* Core
11*b* Upper flange part
11*c* Lower flange part
12 Coil conductive wire
13 Metal wire
14 Insulation sheath
15A, 15B Groove
16A, 16B Terminal electrode

17A, 17B Solder
18 Outer sheath member
20 Circuit board
22 Mounting land
S101 Core member manufacturing step
S102 Terminal electrode forming step
S103 Coil conductive wire winding step
S104 Outer sheath step
S105 Coil conductive wire bonding step

DETAILED DESCRIPTION

A wire-wound inductor conforming to the present invention is explained in detail using an example below.

(Wire-Wound Inductor)

Figure 2:
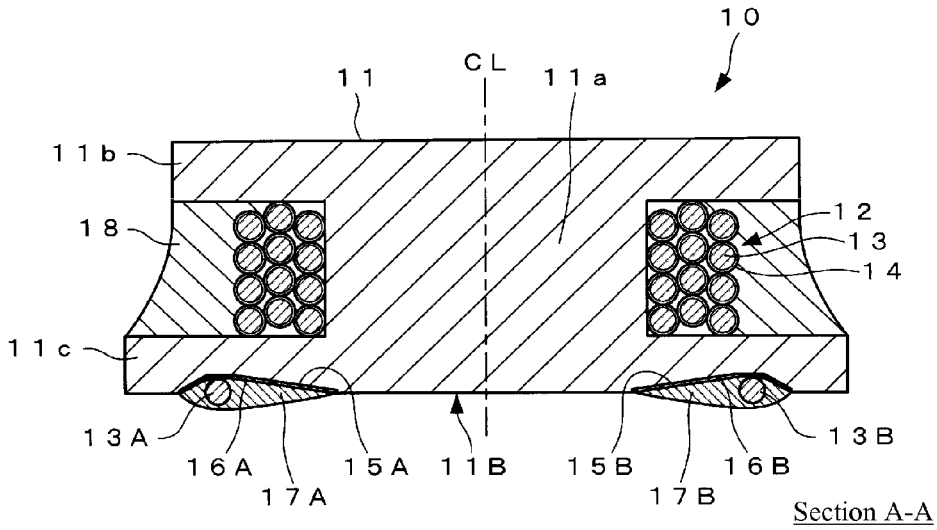
FIG. 2 illustrates a schematic section view showing the internal structure of a wire-wound inductor conforming to the present invention.
Figure 3:
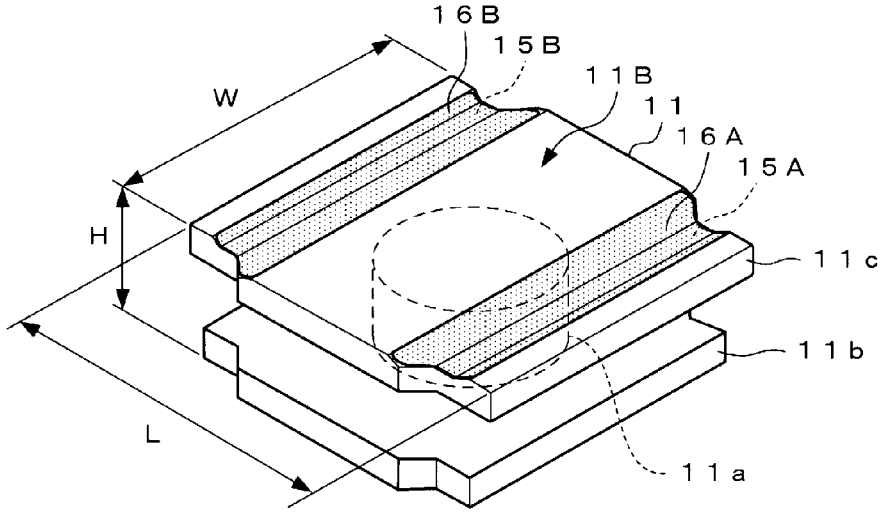
FIG. 3 illustrates a schematic perspective view showing a core member applied to a wire-wound inductor conforming to the present invention.
Figure 4:
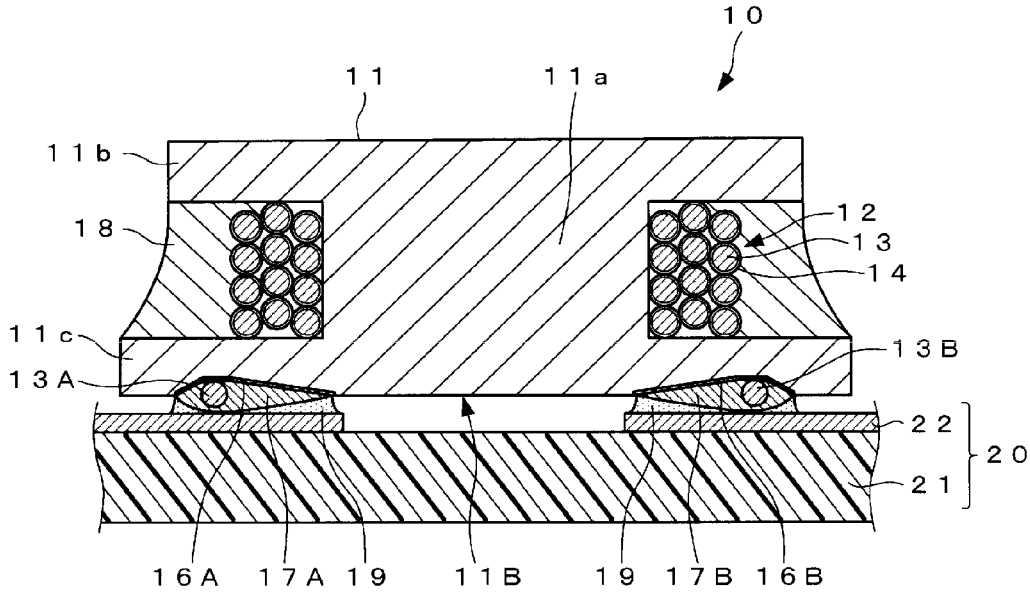
FIG. 4 illustrates a schematic section view showing a condition where a wire-wound inductor conforming to the present invention is mounted onto a circuit board.

FIG. 1 illustrates schematic perspective views showing an embodiment of a wire-wound inductor conforming to the present invention. Here, (a) in FIG. 1 is a schematic perspective view of a wire-wound inductor conforming to the present invention as seen from the top (upper flange part), while (b) in FIG. 1 is a schematic perspective view of a wire-wound inductor conforming to the present invention as seen from the bottom (lower flange part). FIG. 2 is a schematic section view showing the internal structure of a wire-wound inductor shown in (a) in FIG. 1 cut along line A-A conforming to the present invention. FIG. 3 illustrates a schematic perspective view of a coil member applied to a wire-wound inductor conforming to the present invention. FIG. 4 illustrates a schematic section view showing a condition where a wire-wound inductor conforming to the present invention is mounted onto a circuit board.

As shown in (a) and (b) in FIG. 1 and in FIG. 2, a wire-wound inductor 10 conforming to the present invention has a core member 11 having roughly a drum shape, a coil conductive wire 12 wound around the core member 11, a pair of terminal electrodes 16A, 16B connected to ends 13A, 13B of the coil conductive wire 12, and an outer sheath member 18 made of a magnetic powder-containing resin and covering the wound coil conductive wire 12.

To be specific, the core member 11 has a pillar-shaped core 11*a*, an upper flange part 11*b* provided at the upper end of the core 11*a* as shown in the drawing, and a lower flange part 11*c* provided at the lower end of the core 11*a* as shown in the drawing, and externally it has a drum shape, as shown in (a) in FIG. 1 and in FIGS. 2 and 3.

Here, as shown in FIGS. 1 to 3, preferably the core 11*a* of the core member 11 has a rough circular or circular section so that the length of the coil conductive wire 12 needed to achieve a specified number of windings can be minimized, but its shape is not at all limited to the foregoing. Preferably the outer shape of the lower flange part 11*c* of the core member 11 is roughly square or square in a plan view to allow for size reduction to support high-density mounting, but its shape is not at all limited to the foregoing and a polygon, rough circle, or other shape is also acceptable. In addition, preferably the outer shape of the upper flange part 11*b* of the core member 11 is similar to that of the lower flange part 11*c* to allow for size reduction to support high-density mounting, and preferably the upper flange part 11*b* is of the same size as or slightly smaller than the lower flange part 11*c*.

By providing the upper flange part 11*b* and lower flange part 11*c* at the upper end and lower end of the core 11*a* this way, it becomes easier to control the winding position of the coil conductive wire 12 relative to the core 11*a* to stabilize the inductance characteristics. Also, the four corners of the upper flange part 11*b* can be chamfered or otherwise machined as deemed appropriate so as to easily fill the magnetic powder-containing resin, which constitute the outer sheath member 18, between the upper flange part 11*b* and lower flange part 11*c*. The thicknesses of upper flange part 11*b* and lower flange part 11*c* are set as deemed appropriate in such a way that a specified strength can be achieved at the lower-limit values of thickness ranges, by considering the overhang dimensions of the upper flange part 11*b* and lower flange part 11*c* from the core 11*a* of the core member 11, respectively.

Also, as shown in (b) in FIG. 1 and in FIGS. 2 and 3, at the lower flange part 11*c* of the core member 11, a pair of terminal electrodes 16A, 16B are formed on the bottom surface (outer surface) 11B crossing at right angles with the center axis CL of the core 11*a*, in a manner sandwiching a line extended from the center axis CL of the core 11*a*. Here, grooves 15A, 15B are formed on the bottom surface 11B in the area where the pair of terminal electrodes 16A, 16B are formed, as shown in (b) in FIG. 1 and in FIGS. 2 and 3, for example. These grooves 15A, 15B each have a section shape of a rough concave, having at least a bottom and gradually inclining surfaces provided on both sides of the bottom in the width direction at an angle to the bottom, as shown in FIGS. 2 and 3, for example.

Here, the depths of the grooves 15A, 15B are preferably such that, when the terminal electrodes 16A, 16B are formed at the bottom of grooves 15A, 15B and the ends 13A, 13B of the coil conductive wire 12 are positioned at the bottom, the ends 13A, 13B of the coil conductive wire 12 or solders 17A, 17B connecting the ends 13A, 13B and terminal electrodes 16A, 16B are formed in a manner partially projecting from the grooves 15A, 15B beyond the height position of the flat plane of the bottom surface 11B, as shown in FIG. 2, for example. Also, both ends of the grooves 15A, 15B in the length direction are preferably formed in a manner reaching the pair of mutually facing outer surfaces of the lower flange part 11*c*, as shown in FIGS. 1(*b*) and 3. It should be noted that the shapes of grooves 15A, 15B shown here are merely an example that can be applied to a wire-wound inductor conforming to the present invention and their shapes are not at all limited to the foregoing. For example, the grooves 15A, 15B may each have, in addition to the bottom and gradually inclining surfaces, side walls that are steeper than the gradually inclining surfaces to regulate the width direction of the terminal electrodes 16A, 16B, in the area where the gradually inclining surfaces contact the bottom surface 11B of the lower flange part 11*c*. Also, the grooves may not be formed at the bottom surface 11B of the lower flange part 11*c*, and the terminal electrodes 16A, 16B may be provided directly at the bottom surface 11B.

In addition, the wire-wound inductor 10 conforming to this embodiment is characterized in that the core member 11 is constituted by soft magnetic alloy grains containing iron (Fe), silicon (Si) and an element that oxidizes more easily than iron, where each soft magnetic alloy grain has an oxidized layer formed on its surface which results from oxidization of the soft magnetic alloy grain, with the oxidized layer containing a greater amount of the element that oxidizes more easily than does iron when compared to the soft magnetic alloy grain, and the grains are bonded together via their oxidized layers so as to structure the core member (i.e., sustain the shape of the core member) independent of or free of composite bonding such as resin-metal composite bonding; however, localized metal-metal bonding between grains, and/or resin with which the core member is impregnated, are included in the core member in some embodiments). Particularly in this embodiment, chromium (Cr) is used as the element that oxidizes more easily than iron. In other words, the core member 11 is constituted by an assembly of soft magnetic alloy grains that contain iron, silicon and chromium. Here, the soft magnetic alloy grains contain chromium by at least 2 to 15 percent by weight. Also, it is more desirable that the average grain size of soft magnetic alloy grains is around 2 to 30 μm.

The terminal electrodes 16A, 16B are structured in such a way that each has a conductive layer provided along the groove 15A or 15B and is connected to the end 13A or 13B of the coil conductive wire 12, as shown in FIGS. 2 and 3, for example. Also with the terminal electrodes 16A, 16B, preferably their width directions are regulated by the grooves 15A, 15B in such a way that all area from one end to the other end of the width direction is accommodated within the groove 15A or 15B, respectively. For this reason, preferably the section shapes and dimensions of grooves 15A, 15B and thickness dimensions of terminal electrodes 16A, 16B are set as deemed appropriate so as to accommodate the terminal electrodes 16A, 16B within the grooves 15A, 15B.

Also, various electrode materials can be used for the conductive layers constituting the terminal electrodes 16A, 16B. For example, silver (Ag), alloy of silver (Ag) and palladium (Pd), alloy of silver (Ag) and platinum (Pt), copper (Cu), alloy of titanium (Ti), nickel (Ni) and tin (Sn), alloy of titanium (Ti) and copper (Cu), alloy of chromium (Cr), nickel (Ni) and tin (Sn), alloy of titanium (Ti), nickel (Ni) and copper (Cu), alloy of titanium (Ti), nickel (Ni) and silver (Ag), alloy of nickel (Ni) and tin (Sn), alloy of nickel (Ni) and copper (Cu), alloy of nickel (Ni) and silver (Ag), and phosphor bronze, etc., can be applied favorably. For the conductive layer using any of these electrode materials, a baked conductive film can be applied favorably, which is obtained by applying, to the insides of the grooves 15A, 15B and bottom surface 11B of the lower flange part 11*c*, an electrode paste prepared by adding glass to silver (Ag), alloy containing silver (Ag), etc., for example, and then baking the paste at a specified temperature. As another form of the conductive layer, an electrode frame can also be applied favorably, which is obtained by bonding a conductive frame made of phosphor bronze, etc., for example, to the bottom surface 11B of the lower flange part 11*c* using an adhesive made of epoxy resin, etc. As yet another form of the conductive layer, a conductive film can also be applied favorably, which is obtained by forming a metal thin film inside the grooves 15A, 15B and at the bottom surface 11B of the lower flange part 11*c* using titanium (Ti), alloy containing titanium (Ti), etc., for example, by means of the sputtering method, deposition method, etc. For the conductive layers constituting the terminal electrodes 16A, 16B, a metal plating layer of nickel (Ni), tin (Sn), etc., may be formed by means of electroplating on the surface of the baked conductive film or conductive film (metal thin film) mentioned above.

For the coil conductive wire 12, a covered conductive wire is applied which is a metal wire 13 made of copper (Cu), silver (Ag), etc., around which an insulation sheath 14 made of polyurethane resin, polyester resin, etc., is formed, as shown in FIG. 2. As shown in FIGS. 1, 2, the coil conductive wire 12 is wound around the pillar-shaped core 11*a* of the core member 11, while conductively connected via the solders 17A, 17B to the respective conductive layers constituting the terminal electrodes 16A, 16B with the insulation sheath 14 removed at the one and other ends 13A, 13B.

Here, the coil conductive wire 12 is a covered conductive wire of 0.1 to 0.2 mm in diameter, wound 3.5 to 15.5 times around the core 11*a* of the core member 11, for example. The metal wire 13 applied to the coil conductive wire 12 is not limited to a single wire, and it may consist of two or more wires or twisted wires. Also, the metal wire 13 constituting the coil conductive wire 12 is not limited to one having a circular section shape, and a rectangular wire having a rectangular cross section, square wire having a square section shape, etc., can also be used, for example. In addition, the diameters of the ends 13A, 13B of the coil conductive wire 12 are preferably larger than the depths of the grooves 15A, 15B where the terminal electrodes 16A, 16B are formed.

As for the conductive connection via the solders 17A, 17B mentioned above, it suffices that there are locations where the terminal electrodes 16A, 16B are conductively connected via the solders 17A, 17B to the ends 13A, 13B of the coil conductive wire 12, and the means for conductive connection is not limited to soldering. For example, there may be locations where the terminal electrodes 16A, 16B are joined to the ends 13A, 13B of the coil conductive wire 12 by metal-metal bonding through thermal compression, with the joined locations covered by soldering.

Preferably the outer sheath member 18 is constituted by a magnetic powder-containing resin, with the magnetic powder-containing resin having visco-elasticity within the service temperature range of the wire-wound inductor 10. To be more specific, a magnetic powder-containing resin whose glass transition temperature is 100 to 150° C. in the process of transitioning from glass state to rubber state as the rigidity ratio changes relative to temperature due to the curing property of the resin, can be applied favorably. Among the resins that can be used for the magnetic powder-containing resin, silicon resin can be applied favorably, while application of a mixed resin of epoxy resin and carboxyl base denatured propylene glycol, for example, is more preferred as it can shorten the lead time of the process where the magnetic powder-containing resin is charged between the upper flange part 11*b* and lower flange part 11*c* of the core member 11.

Also, preferably the outer sheath member 18 has its magnetic permeation ratio set to a range of 1 to 25. Here, although various magnetic powders can be used for the magnetic powder contained in the magnetic powder-containing resin constituting the outer sheath member 18, it is preferable to use a magnetic powder having the same composition and structure as those of the soft magnetic alloy grains constituting the core member 11, one containing such magnetic powder, or one made of Ni—Zn ferrite or Mn—Zn ferrite, for example. When a magnetic powder having the same composition as those of the soft magnetic alloy grains constituting the core member 11 or one containing such magnetic powder is used, preferably the average grain size of the magnetic powder is approx. 5 to 30 μm. In addition, preferably the content of the magnetic powder in the magnetic powder-containing resin is approx. 0 to 94 percent by weight.

With the wire-wound inductor 10 conforming to this embodiment, a high direct-current bias value (Idc) and high inductance value (L value) can be achieved and occurrence of eddy current loss in the grains can be suppressed even at frequencies of 100 kHz or above, by constituting the core member 11 as an assembly of soft magnetic alloy grains and also by setting the content of chromium in the soft magnetic alloy grains and average grain size of soft magnetic alloy grains as desired within the above ranges, as mentioned above. This is explained in detail in the section of "Verification of Operation/Effects" later on.

In addition, as shown in FIG. 4, the wire-wound inductor 10 having the aforementioned constitution is mounted, by means of soldering 19, on a circuit board 20 which is a glass-epoxy resin board 21 with a mounting land 22 formed on it by copper foil, for example. Here, the wire-wound inductor 10 is mounted onto the mounting land 22 by first printing cream solder onto the circuit board 20, after which the wire-wound inductor 10 is placed on the mounting land 22 and then reflow-soldered by heating to 245° C., for example.

(Method for Manufacturing Wire-Wound Inductor)

Next, the method for manufacturing the aforementioned wire-wound inductor is explained.

Figure 5:
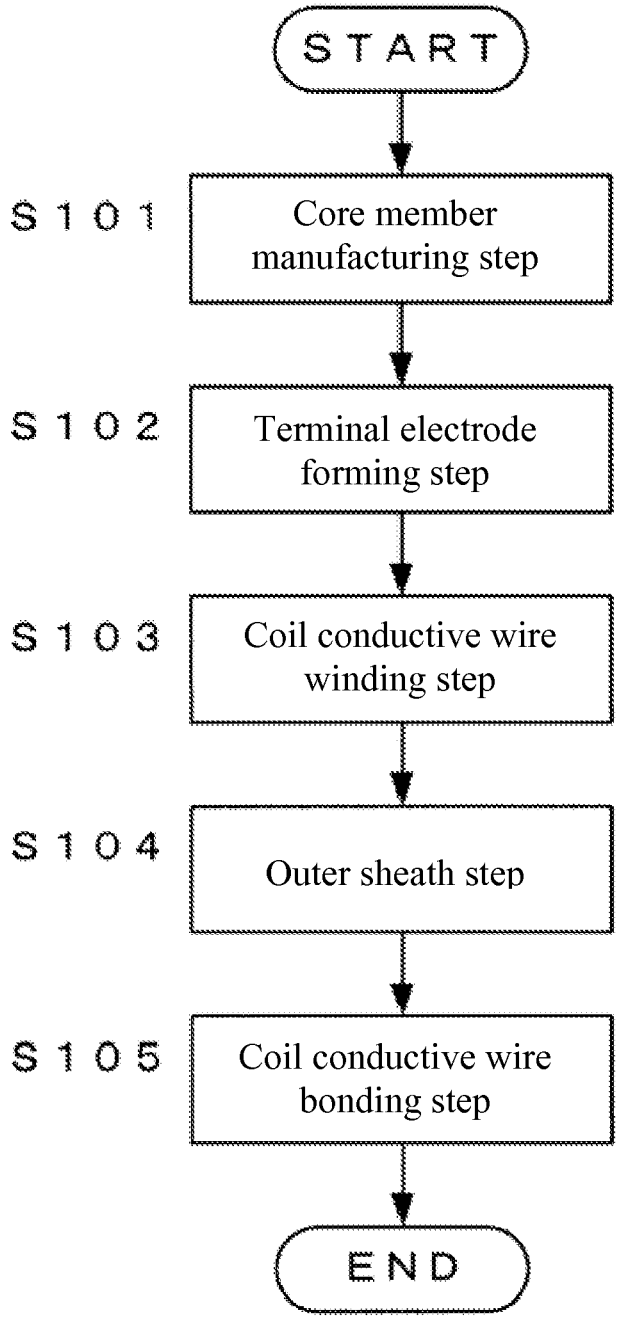
FIG. 5 is flow chart showing a method for manufacturing a wire-wound inductor conforming to the present invention.

FIG. 5 is a flow chart showing a method for manufacturing the wire-wound inductor conforming to this embodiment.

The aforementioned wire-wound inductor is manufactured roughly through a core member manufacturing step S101, terminal electrode forming step S102, coil conductive wire winding step S103, outer sheath step S104, and coil conductive wire bonding step S105, as shown in FIG. 5.

(a) Core Member Manufacturing Step S101

In the core member manufacturing step S101, first a compact of a specified shape is formed by using as material grains a group of soft magnetic alloy grains containing iron (Fe), silicon (Si) and chromium (Cr) at a specified ratio and then mixing with a specified binder. To be specific, material grains containing chromium by 2 to 15 percent by weight, silicon by 0.5 to 7 percent by weight, and iron for the remainder, are mixed with a binder constituted by a thermoplastic resin, for example, after which the grains and binder are agitated and mixed to form granules. Next, these granules are compression-molded using a powder molding press to form a compact, which is then centerlessly ground using a grinding disk, for example, to form a concave between the upper flange part 11*b* and lower flange part 11*c* so as to form the pillar-shaped core 11*a*, thereby obtaining a drum-shaped compact.

Next, the obtained compact is sintered. To be specific, the compact is heat-treated in atmosphere at temperatures of 400 to 900° C. By heat-treating the compact in atmosphere this way, the mixed thermoplastic resin is removed (binder is removed), while an oxidized layer constituted by a metal oxide is formed on the grain surface through bonding of chromium in the grain that has moved to the surface as a result of heat treatment, iron being the main constituent of the grain, and oxygen, with the oxidized layers on the surfaces of adjacent grains bonding together at the same time. The generated oxidized layer (metal oxide layer) is an oxide primarily constituted by iron and chromium and has the function to provide the core member 11 comprising an assembly of soft magnetic alloy grains while ensuring insulation between the grains.

Here, grains manufactured by the water atomization method can be used for the above material grains, for example, where examples of material grain shapes include sphere and flat. Also, raising the heat treatment temperature in an oxygen atmosphere during the above heat treatment breaks down the binder and oxidizes the soft magnetic alloy grains. Accordingly, a preferable heat treatment condition of the compact is to hold a temperature of 400 to 900° C. for 1 minute or longer in atmosphere. Excellent oxidized layer can be formed by implementing heat treatment within these temperature ranges. A more preferable condition is 600 to 800° C. Instead of doing it in atmosphere, heat treatment may be implemented in an atmosphere where the oxygen component pressure is equivalent to that of atmosphere. In a reducing atmosphere or non-oxidizing atmosphere, no oxidized layer is formed by metal oxide as a result of heat treatment, so the grains sinter together and volume resistivity drops significantly. Also, while the oxygen concentration and water vapor volume in the atmosphere are not specifically limited, an atmosphere or dry air is preferred in consideration of production benefits.

Excellent strength and excellent volume resistivity can be achieved by setting the temperature to above 400° C. in the above heat treatment. On the other hand, a heat treatment temperature above 900° C. increases the strength, but reduces the volume resistivity. Furthermore, an oxidized layer of a metal oxide containing iron and chromium is produced easily when the above heat treatment temperature is held for 1 minute or longer. Here, while the upper limit of holding time is not specifically set as the thickness of the oxidized layer saturation at a specified value, it is appropriate to keep the holding time to 2 hours or less in consideration of productivity.

As explained above, formation of oxidized layer can be controlled by the heat treatment temperature, heat treatment time, oxygen amount in the heat treatment atmosphere, etc., and therefore by using the heat treatment conditions in the above ranges, a core member 11 offering excellent strength and excellent volume resistivity at the same time can be manufactured as an assembly of soft magnetic alloy grains having oxidized layers.

To be specific, a cylindrical sample is cut out from the core member of a product manufactured hereunder for use as an evaluation sample. Here, an electrode paste constituted by silver (Ag), resin, etc., was applied to both end faces of the cylindrical sample and then hardened, after which volume resistivity was measured using an insulation tester ("Meghaohmmeter Model SM-21" by TOA) at a voltage of 5 to 20 V.

The core member 11 conforming to this embodiment was confirmed to have a high volume resistivity of approx. $10^3$ to $10^9$ Ω·cm. This means that the inherently high magnetic permeation ratio of the soft magnetic alloy grains constituting the core member 11 can be fully utilized to improve the direct current superimposition characteristics while contributing significantly to the increase of current. Particularly with the core member 11 conforming to this embodiment where the insulation layer of each soft magnetic alloy grain uses an oxidized layer formed by oxidization of the grain, there is no need to mix resin or glass into soft magnetic grains to bond the grains together for the purpose of insulation. Accordingly, neither resin nor glass is used and there is no need to apply a high molding pressure, unlike with a wire-wound inductor formed by bonding together soft magnetic alloy grains using resin or glass (corresponding to the metal composite structure explained layer), and consequently a wire-wound inductor having the above characteristics can be manufactured using a simple, low-cost manufacturing method.

The above drum-shaped compact is not necessarily obtained by forming a concave via centerless grinding on the peripheral side face of a compact formed by granules containing material grains, and it is also possible to obtain a drum-shaped compact by integrally forming the granules in dry state using a powder molding press, for example. Another manufacturing method for the core member 11 is that, instead of preparing a drum-shaped compact first and then sintering the compact as mentioned above, a compact formed by the above grains (compact not yet having a concave formed on its peripheral side face) is prepared, after which the binder is removed and the compact is sintered at a specified temperature, and then a concave is formed on the peripheral side face of the sintered compact by means of cutting using a diamond wheel, etc., for example.

Also, the method for forming the grooves 15A, 15B at the bottom surface 11B of the core member 11 is not limited to one whereby a pair of elongated protrusions are provided on the surface of a die when a compact is formed by granules containing material grains in the manufacturing process of the core member 11 in order to form the grooves at the same time as the compact is formed, and a pair of grooves can be formed instead by cutting the surface of the obtained compact, for example.

(b) Terminal Electrode Forming Step S102

Next, in the terminal electrode forming step S102, a conductive layer constituted by an electrode material as mentioned above is formed in the grooves 15A, 15B that have been formed at the bottom surface 11B of the lower flange part 11*c* of the core member 11. Here, the electrode layer can be formed by applying various methods, such as a method to apply and bake an electrode paste at a specified temperature, a method to bond a conductive frame using adhesive, or a method to form a thin film using the sputtering method, deposition method, etc., as mentioned earlier. Here, a method to apply and bake an electrode paste is explained as an example of a method associated with the lowest manufacturing cost and high productivity.

In the terminal electrode forming step, an electrode paste containing an electrode material (such as silver, copper or several types of metal materials including the foregoing) in powder form with glass frit is applied to the insides of the grooves 15A, 15B or bottom surface 11B of the lower flange part 11*c*, after which the core member 11 is heat-treated to form terminal electrodes 16A, 16B.

Here, the electrode paste can be applied using, for example, the roller transfer method, pad transfer method or other transfer method, screen printing method, stencil printing or other printing method, spray method, and inkjet method, among others. Among these, a transfer method is more preferred so as to accommodate the edges of terminal electrodes 16A, 16B in the width direction within the grooves 15A, 15B in a favorable manner.

In addition, the contents of electrode material and glass in the electrode paste are set as deemed appropriate according to the type, composition, etc., of the electrode material used, among others. The glass composition in the electrode paste contains a glass and metal oxide constituted by silicon (Si), zinc (Zn), aluminum (Al), titanium (Ti), calcium (Ca), etc., for example. Also, heat treatment (electrode baking) of the core member 11 after the electrode paste has been applied to the bottom surface 11B of the lower flange part 11*c* is implemented in atmosphere or $N_2$ gas ambience with an oxygen concentration of 10 ppm or less, at a temperature of 750 to 900° C. By forming the terminal electrodes 16A, 16B this way, the core member 11 is strongly bonded to the conductive layer constituted by a specified electrode material.

(c) Coil Conductive Wire Winding Step S103

Next, in the coil conductive wire winding step S103, the covered conductive wire is wound around the core 11*a* of the core member 11 by a specified number of times. To be specific, the upper flange part 11*b* of the core member 11 is secured by a chuck on a winding apparatus in such a way that the core 11*a* of the core member 11 is exposed. Next, for example, a covered conductive wire of 0.1 to 0.2 mm in diameter is temporarily fixed to one of the terminal electrodes 16A, 16B (or grooves 15A, 15B) formed at the bottom surface 11B of the lower flange part 11*c*, and then cut in this condition to obtain one end of the coil conductive wire 12. Thereafter, the chuck is turned and the covered conductive wire is wound 3.5 to 15.5 times around the core 11*a*, for example. Next, the covered conductive wire temporarily fixed to the other of the terminal electrodes 16A, 16B (or grooves 15A, 15B), and then cut in this condition to obtain the other end of the coil conductive wire 12, thereby forming a core member 11 having a coil conductive wire 12 wound around its core 11*a*. The one end and other end of the coil conductive wire 12 correspond to the ends 13A, 13B mentioned above.

(d) Outer Sheath Step S104

Next, in the outer sheath step S104, an outer sheath member 18 constituted by a magnetic powder-containing resin having a specified magnetic permeation ratio is coated and formed on the outer periphery of the coil conductive wire 12 wound around the core 11*a*, between the upper flange part 11*b* and lower flange part 11*c* of the core member 11. To be specific, for example, a magnetic powder-containing resin paste that contains a magnetic powder having the same composition and structure as those of the soft magnetic alloy grains constituting the core member 11 is discharged onto the area between the upper flange part 11*b* and lower flange part 11*c* of the core member 11 using a dispenser, to coat the outer periphery of the coil conductive wire 12. Next, the magnetic powder-containing resin paste is cured by heating at 150° C. for 1 hour, for example, to form an outer sheath member 18 covering the coil conductive wire 12.

(e) Coil Conductive Wire Bonding Step S105

In the coil conductive wire bonding step S105, the insulation sheath 14 is peeled and removed from both ends 13A, 13B of the coil conductive wire 12 wound around the core member 11. To be specific, a sheath release solvent is applied to, or laser beam of a specified energy is irradiated onto, both ends 13A, 13B of the coil conductive wire 12 wound around the core member 11, to melt or vaporize the resin material forming the insulation sheath 14 near both ends 13A, 13B of the coil conductive wire 12, to completely peel and remove the material.

Next, both ends 13A, 13B of the coil conductive wire 12 from which the insulation sheath 14 has been peeled, are soldered and conductively connected to the respective terminal electrodes 16A, 16B. To be specific, a solder paste containing flux is applied by the stencil printing method, for example, onto the respective terminal electrodes 16A, 16B containing both ends 13A, 13B of the coil conductive wire 12 from which the insulation sheath 14 has been peeled, after which pressure is applied under heating using a hot plate heated to 240° C. to melt and fix the solder to join both ends 13A, 13B of the coil conductive wire 12 to the respective terminal electrodes 16A, 16B via the solders 17A, 17B. After the coil conductive wire 12 has been soldered to the terminal electrodes 16A, 16B, washing is performed to remove the flux residue.

By peeling the insulation sheath 14 from both ends 13A, 13B of the coil conductive wire 12 prior to the step of soldering the coil conductive wire 12 to the terminal electrodes 16A, 16B, solder wettability relative to the coil conductive wire 12 can be improved and the coil conductive wire 12 can be conductively connected to the terminal electrodes 16A, 16B in a favorable manner while ensuring joining strength.

(Verification of Operation/Effects)

Next, the operation/effects of the wire-wound inductor conforming to this embodiment are explained.

Here, a wire-wound inductor having the parameters and composition described below was used as a sample to verify the operation/effects of the wire-wound inductor conforming to this embodiment.

With the wire-wound inductor 10 shown in FIG. 1, the core member 11 was formed by an assembly of soft magnetic alloy grains containing iron (Fe), silicon (Si) and 2 to 15 percent by weight of chromium (Cr) and having an oxide film formed on their surface. Also, key outer dimensions of the core member 11 shown in FIG. 3 were set as length L=3 to 5 mm, width W=3 to 5 mm and height H=1.5 mm or less, while a covered conductive wire of 0.1 to 0.2 mm in diameter was used as the coil conductive wire 12 to be wound around the core 11*a* of the core member 11 and this wire was wound by somewhere between 3.5 and 15.5 times. In addition, the outer sheath member 18 was formed by a magnetic powder-containing resin that contains a magnetic powder having the same composition and structure as those of the soft magnetic alloy grains constituting the core member 11.

Figure 6:
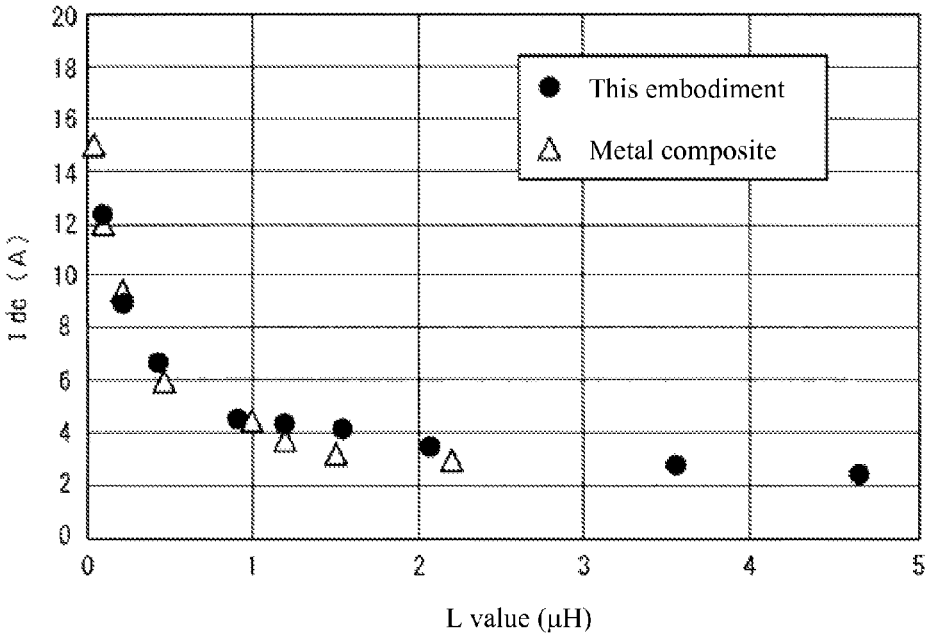
FIG. 6 is a figure explaining the superiority of inductor characteristics of a wire-wound inductor conforming to the present invention.

FIG. 6 is a figure explaining the superiority of inductor characteristics of the wire-wound inductor conforming to this embodiment. Here, FIG. 6 is specifically a graph showing the inductance vs. direct current superimposition characteristics (L vs. Idc characteristics) of the wire-wound inductor conforming to this embodiment and a wire-wound inductor of the metal composite structure. Here, inductance vs. direct current superimposition characteristics show the direct current superimposition value (Idc) relative to the inductance value (L value), where the direct current superimposition value indicates the current when direct current is superimposed and the inductance value (L value) drops by 20% (=becomes −20% of the initial value) as a result of applying a direct current bias to the inductor.

As for the core member 11 in this embodiment, use of an assembly of soft magnetic alloy grains containing iron (Fe), silicon (Si) and 2 to 15 percent by weight of chromium (Cr) can achieve a high magnetic permeation ratio μ (10 or more) and high saturated magnetic flux density Bs (1.2 T or more).

To be specific, a cylindrical sample is cut out from the core member of a product manufactured hereunder for use as an evaluation sample. The cylindrical sample has a length of approx. 1 mm and diameter of approx. one-tenth the length. Here, a VSM (vibrating sample magnetometer) was used to obtain the saturated magnetic flux density Bs and magnetic permeation ratio μ of this sample. The obtained values of saturated magnetic flux density and magnetic permeation ratio were 1.36 T and 17, respectively. The magnetic permeation ratio of the insulation member covering the outer periphery of the coil conductive wire was also measured with the same method.

As a result, the core member 11 conforming to this embodiment was confirmed to have a high saturated magnetic flux density Bs of approx. 1.2 T or more and high magnetic permeation ratio μ of approx. 10 or more. This way, the wire-wound inductor 10 conforming to this embodiment can achieve excellent inductor characteristics (L vs. Idc characteristics) as shown in FIG. 6. Here, FIG. 6 also shows the inductor characteristics of the comparison wire-wound inductor of a metal composite structure. It should be noted that the wire-wound inductor of the metal composite structure is a product already available on the general market and used in various types of electronic devices, with its excellent inductor characteristics as a power inductor for power-supply circuit, etc., it is highly recognized in the market.

As shown in FIG. 6, a comparison of the L vs. Idc characteristics of the wire-wound inductor conforming to this embodiment and those of the wire-wound inductor of the metal composite structure found that the behaviors of both were similar and that the direct current superimposition value (Idc) relative to the inductance value (L value) was generally greater with the wire-wound inductor conforming to this embodiment. This confirms that the wire-wound inductor conforming to this embodiment has excellent inductor characteristics (L vs. Idc characteristics) equivalent to or better than the comparison wire-wound inductor of metal composite structure.

Accordingly, this embodiment can achieve a wire-wound inductor offering excellent inductor characteristics to accommodate larger current, or wire-wound inductor that allows for low-height mounting to accommodate an equivalent amount of current with the core member having smaller outer dimensions. Such wire-wound inductor is extremely effective when applied as a power inductor, etc. Furthermore, in this case neither resin nor glass is used and there is no need to apply a high molding pressure, unlike with the wire-wound inductor of metal composite structure where soft magnetic alloy grains are bonded together using resin or glass, which means that a wire-wound inductor offering the above characteristics can be manufactured using a simple, low-cost manufacturing method. In addition, the core member of the wire-wound inductor conforming to this embodiment maintains a high saturated magnetic flux density while preventing the glass component, etc., from rising to the surface of the core member after heat treatment in atmosphere, so a small wire-wound inductor having higher dimensional stability than its metal composite structure counterpart can be achieved.

The present invention is suitable for wire-wound inductors whose size has been reduced for surface mounting on circuit boards. Particularly when applied to a power inductor or other inductor carrying large current, the present invention proves extremely effective as it can improve inductor characteristics while enabling low-height mounting at the same time.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. In this disclosure, any defined meanings do not necessarily exclude ordinary and customary meanings in some embodiments. Also, in this disclosure, "the invention" or "the present invention" refers to one or more of the embodiments or aspects explicitly, necessarily, or inherently disclosed herein.

The present application claims priority to Japanese Patent Application No. 2011-183446, filed Aug. 25, 2011, the disclosure of which is incorporated herein by reference in its entirety. In some embodiments, as the base material and structures thereof, those disclosed in U.S. Patent Application Publication No. 2011/0267167 and No. 2012/0038449, co-assigned U.S. patent application Ser. No. 13/313,982, Ser. No. 13/313,999, and Ser. No. 13/351,078 can be used, each disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A wire-wound inductor comprising:

a core member having a pillar-shaped core and a pair of flange parts provided on both sides of the core;

a coil conductive wire wound around the core of the core member;

a pair of terminal electrodes provided on an outer surface of the flange parts and connected to both ends of the coil conductive wire; and an insulation member covering an outer periphery of the coil conductive wire;

wherein the core member is constituted by soft magnetic alloy grains containing iron, silicon, and chromium, where each soft magnetic alloy grain has an oxidized layer of the soft magnetic alloy grain on its surface, the oxidized layer contains more chromium than does the soft magnetic alloy grain, and the grains are bonded together via their oxidized layers so as to structure the core member independent of composite bonding;

wherein the soft magnetic alloy contains chromium by 2 to 15 percent by weight;

wherein the core member has a saturated magnetic flux density of 1.2 T or more, volume resistivity of $10^3$ to $10^9$ Ω·cm, and magnetic permeation ratio of 10 or more; and wherein the insulation member is constituted by a resin material containing magnetic powder and has a designated magnetic permeation ratio.

2. A wire-wound inductor according to claim 1, wherein the core member has outer dimensions of 3 to 5 mm in length and width, and a height dimension of 1.5 mm or less measured in a plan view of the outer surface of the flange parts.

3. A wire-wound inductor according to claim 2, wherein the magnetic powder contained in the insulation member has substantially the same composition and structure as the soft magnetic alloy grains constituting the core member.

4. A wire-wound inductor according to claim 3, wherein the insulation member has a magnetic permeation ratio of 1 to 25.

5. A wire-wound inductor according to claim 2, wherein the magnetic powder contained in the insulation member is made of Ni—Zn ferrite or Mn—Zn ferrite.

6. A wire-wound inductor according to claim 5, wherein the insulation member has a magnetic permeation ratio of 1 to 25.

7. A wire-wound inductor according to claim 2, wherein the insulation member has a magnetic permeation ratio of 1 to 25.

8. A wire-wound inductor according to claim 1, wherein the magnetic powder contained in the insulation member has substantially the same composition and structure as the soft magnetic alloy grains constituting the core member.

9. A wire-wound inductor according to claim 8, wherein the insulation member has a magnetic permeation ratio of 1 to 25.

10. A wire-wound inductor according to claim 1, wherein the magnetic powder contained in the insulation member is made of Ni—Zn ferrite or Mn—Zn ferrite.

11. A wire-wound inductor according to claim 10, wherein the insulation member has a magnetic permeation ratio of 1 to 25.

12. A wire-wound inductor according to claim 1, wherein the insulation member has a magnetic permeation ratio of 1 to 25.

13. A wire-wound inductor according to claim 1, wherein the core member is free of composite bonding.

14. A wire-wound inductor according to claim 1, wherein the pair of terminal electrodes are provided on the same outer surface of one of the flange parts.

* * * * *